US009464248B2

(12) United States Patent
Fischer et al.

(10) Patent No.: US 9,464,248 B2
(45) Date of Patent: Oct. 11, 2016

(54) COMBINED QUENCHING AND SCRUBBING SYSTEM WITH GUIDE TUBE FOR AN ENTRAINED FLOW GASIFYING REACTOR

(71) Applicant: SIEMENS AKTIENGESELLSCHAFT, München (DE)

(72) Inventors: Norbert Fischer, Lichtenberg (DE); Frank Hannemann, Freiberg (DE); Tino Just, Freiberg (DE); Manfred Schingnitz, Freiberg (DE); Guido Schuld, Dresden (DE)

(73) Assignee: SIEMENS AKTIENGESELLSCHAFT (DE)

( * ) Notice: Subject to any disclaimer, the term of this patent is extended or adjusted under 35 U.S.C. 154(b) by 120 days.

(21) Appl. No.: 14/474,611

(22) Filed: Sep. 2, 2014

(65) Prior Publication Data

US 2015/0059246 A1 Mar. 5, 2015

(30) Foreign Application Priority Data

Sep. 2, 2013 (DE) ..... 10 2013 217 450

(51) Int. Cl.
*C10K 1/02* (2006.01)
*C10K 1/06* (2006.01)
*C10K 1/10* (2006.01)

(52) U.S. Cl.
CPC . *C10K 1/02* (2013.01); *C10K 1/06* (2013.01); *C10K 1/101* (2013.01)

(58) Field of Classification Search
CPC ..... C10J 3/845
See application file for complete search history.

(56) References Cited

U.S. PATENT DOCUMENTS 4,367,076 A 1/1983 Peise et al.
5,324,336 A 6/1994 Child
8,240,259 B2 8/2012 Fischer et al.
(Continued)

FOREIGN PATENT DOCUMENTS

DE 145860 A3 1/1981
DE 224045 A1 6/1985
(Continued)

OTHER PUBLICATIONS

Schmalfeld J. et al: Die Veredlung und Umwandlung von Kohle, Technologien und Projekte 1970 bis 2000 in Deutschland, Deutsche Wissenschaftliche Gesellschaft für Erdöl, Erdgas und Kohle e.V., Kapitel 4.4.2 Gaskombinat Schwarze Pumpe-Verfahren (GSP), pp. 537-552, Dec. 2008.

*Primary Examiner* — Matthew Merkling
(74) *Attorney, Agent, or Firm* — Ostrolenk Faber LLP

(57) ABSTRACT

A three-stage quenching and scrubbing system for treatment of hot crude gases and liquid slag after an entrained flow gasification. In the first primary stage, cooling and scrubbing water is injected such that slag can no longer adhere to the wall of the central tube and the conversion reaction of the carbon monoxide with water vapor to give hydrogen can proceed to close to the equilibrium. A secondary quenching and scrubbing stage takes the form of a bubble column, and further cooling and the deposition of coarse dust and slag are effected in a water bath. The rest of the treatment is through intensive spraying in a tertiary quenching and scrubbing the gas stage, nozzle rings for deposition of fine slag and partly of fine dust. All three quenching and scrubbing stages enable cooling of the crude gas down to the water vapor dew point determined by the plant pressure.

10 Claims, 3 Drawing Sheets

(56) References Cited

U.S. PATENT DOCUMENTS

| | | | | |
|---|---|---|---|---|
| 8,770,555 | B2 | 7/2014 | Schulze et al. | |
| 9,200,223 | B2 * | 12/2015 | Talcott | C10K 1/04 |
| 2007/0044381 | A1 | 3/2007 | Holle et al. | |

FOREIGN PATENT DOCUMENTS

| | | | |
|---|---|---|---|
| DE | 265051 | A3 | 2/1989 |
| DE | 4446803 | C2 | 5/1998 |
| DE | 19718131 | C2 | 10/1999 |
| DE | 19952754 | A1 | 5/2001 |
| DE | 102005041930 | A1 | 3/2007 |
| DE | 102005031816 | B4 | 4/2008 |
| DE | 102007042543 | A1 | 3/2009 |
| EP | 0677567 | B1 | 9/1997 |

* cited by examiner

COMBINED QUENCHING AND SCRUBBING SYSTEM WITH GUIDE TUBE FOR AN ENTRAINED FLOW GASIFYING REACTOR

CROSS-REFERENCE TO RELATED APPLICATION

The present non-provisional patent application claims the benefit of priority from German Patent Application No. 102013217450.0, filed Sep. 2, 2013, the entire contents of which are incorporated herein by reference.

TECHNICAL BACKGROUND

The invention relates to a multistage crude gas scrubbing system having a high deposition level of dust in an entrained flow gasifying unit for the reaction of ash-containing fuels with a gasifying agent containing free oxygen to give a crude gas, while obtaining a high hydrogen content.

The invention further relates to process steps in an apparatus for treatment of circulation water in the cleaning of crude gases from an entrained flow gasifying plant, in which fuel dusts are reacted with oxygen and moderators such as steam or carbon dioxide at temperatures between 1200-1900° C. and pressures up to 10 MPa to give a crude gas rich in CO and $H_2$.

Fuel dusts are understood to mean finely ground coals of different carbonization level, dusts formed from biomasses, products of thermal pre-treatment, such as cokes, torrefaction products and fractions having high calorific values from communal and commercial residual and waste materials. The fuel dusts can be supplied to the gasification as a gas/solid or liquid/solid suspension.

The gasification reactors can be provided with a cooling screen or with a refractory lining, as shown by the patents DE 4446803 and EP 0677567. In various systems introduced in industry, crude gas and the molten slag can be discharged separately or together from the reaction space of the gasification apparatus, as described in DE 19718131.

Entrained flow gasification, because of the fuel particles ground to a dust and short reaction times in the gasification space, cause an elevated dust content in the crude gas. Depending on the reactivity of the fuel, this entrained dust consists of soot, unconverted fuel particles and fine particles of slag and ash. The size varies between coarse particles having diameters greater than 0.5 mm and fine particles having a diameter down to 0.1 μm. The separability of the particles from the crude gas depends on this diameter, but also on the composition thereof. In principle, a distinction can be made between soot and ash or slag particles, soot particles generally being smaller and more difficult to separate from the crude gas. Slag particles have a higher density and hence better separability but, in contrast, have a higher hardness and hence erosive action. This leads to increased wear in the separators and crude gas-conducting lines, and can cause safety-relevant leaks and lifetime restrictions.

For the removal of the dusts resulting from the fuels, various scrubbing systems are being used conventionally, as described in patent document DE 10 2005 041 930 and in "Die Veredlung von Kohle" [The Addition of Value to Coal], DGMK, Hamburg, December 2008, Schingnitz, chapter on "GSP-Verfahren" [GSP Processes]. According to this, the crude gasification gas leaves the gasification space together with the slag formed from the fuel ash at temperatures of 1200-1900° C. and is cooled in a downstream quench space by injection of excess water and freed of the slag and, to a small extent, of entrained dust, it being possible for the quench space to be configured as a cavity quench or provided with a crude gas-conducting central tube. A cavity quench system is disclosed, for example, in DE 10 2007 042543, in which the crude gas that leaves the gasification space is sprayed with water and drawn off in the lower section beneath a roof construction. DE 10 2006 031816 exhibits a clear quench space entirely without internals, with injection of quench water at one or more levels in such an amount that the crude gas is cooled and saturated with steam, and the excess quench water is drawn off in the lower section alone or together with deposited slag. Variants with a central tube are disclosed by the patents DE 199 52 754, in which the central tube takes the form of a Venturi tube, DD 145 860, in which the crude gas at the end of the central tube is subjected to additional scrubbing in the form of an airlift pump, and DD 265 051, where elements for distribution of the crude gas flowing out at the end of the central tube are supposed to ensure uniform flow outward.

The solution according to patent DE 10 2007 042 543 has the disadvantage that the cavity, as a result of pipelines of relatively high diameter for the removal of crude gas and the roof construction, offers deposition surfaces for entrained slags and dusts, which, as experience has shown, leads to blockages. DE 10 2006 031816 requires homogeneous flow of the hot crude gas out of the gasification space, because there could otherwise be the risk of thermal overloading of the pressure-bearing vessel walls. The arrangement of a Venturi tube according to DE 199 52 754 can lead to unwanted variations in pressure in the gasification space, and these can barely be compensated for by means of control technology because of their short duration of action. Internals in the quench space and scrub space, as in the patents DD 256 051 and DD 224 045, can lead, as a result of the puzzolanic properties particularly of the fine dust components in the case of particular coal and ash types, to accumulating deposits having the strength of cement, which likewise lead to blockages and to an increase in pressure drop.

The problem addressed by the invention is that of providing a quenching and scrubbing system for an entrained flow gasification reactor for cooling of the hot gasification gas and the entrained liquid slag, wherein both cooling of the hot crude gas down to the water vapor saturation temperature determined by the process pressure and simultaneous deposition of slag and dust are to be achieved. In addition, the conversion and reaction between carbon monoxide and water vapor which thus proceeds is to lead to a relatively high hydrogen content in the crude gas.

SUMMARY OF THE INVENTION

The problem is solved by a combined crude gas scrubbing system having the features disclosed herein.

The invention provides a combined quenching and scrubbing system for an entrained flow gasification reactor with a primary, secondary and tertiary stage. By means of a plurality of stages connected in series in a quench system, firstly a high deposition level of particles and secondly cooling of the crude gas down to the water vapor dew point determined by the plant pressure, which enables a high hydrogen content in the crude gas, are achieved.

According to the invention, the crude gasification gas at 1200 to 1900° C. is subjected to a multistage cooling and scrubbing system at pressures up to 10 MPa. This involves feeding the crude gas from the gasification space 1 to a water bath 9 through a common water-cooled gas and slag outlet device 3, a downstream, likewise water-cooled guide tube 4 and a central tube 5 present in the center of the quench space. At the end of the guide tube, in a first cooling stage, a sufficient amount of water that the temperature goes below the softening temperature of the slag of 800 to 1000° C. is injected into the stream of gas and slag. The diameter of the central tube, which is irrigated in further stages, is selected such that the gas velocity does not exceed 20 m/s. The central tube dips into the water bath as the second cooling and cleaning stage, and the crude gas flows upward in fine distribution in the water bath and the clear annular gap above it, and at the same time is freed further of coarse dust and slag particles. For this purpose, the ring space, which is free of internals, is irrigated in several stages through nozzle rings as the third cleaning stage. The dimensions of the ring space are such that the flow rate of the crude gas does not exceed 0.5 m/s. The crude gas which has been cooled down to the saturation temperature leaves the quench device at the top and is sent to further processing stages for production of a usable clean gas. The pressure casing may be protected against overheating, abrasion and corrosion by an inner casing, in which case the intermediate space is purged constantly with water which flows downward as a water film on the inside of the inner casing. The inner casing with its water film contributes to further cooling and cleaning of the crude gas. The slag deposited is removed from the quencher at the bottom together with coarse dust. The water level in the ring space is kept at the desired level by means of regulated removal of the excess water 16. The central tube 5 may be configured as a double-walled central tube 24 which forms an annular channel into which cooling water 25 is supplied at the upper end. The cooling water 25 passes through the lower end of the annular gap into the water bath 9. The cooling water 25 serves to cool the central tube 24, as a result of which the crude gas passing along it is also cooled.

BRIEF DESCRIPTION OF THE DRAWINGS

The invention is illustrated hereinafter using three working examples, with reference to three figures. The figures show.

DESCRIPTION OF EMBODIMENTS

In the figures, identical designations denote identical elements.

Figure 1:
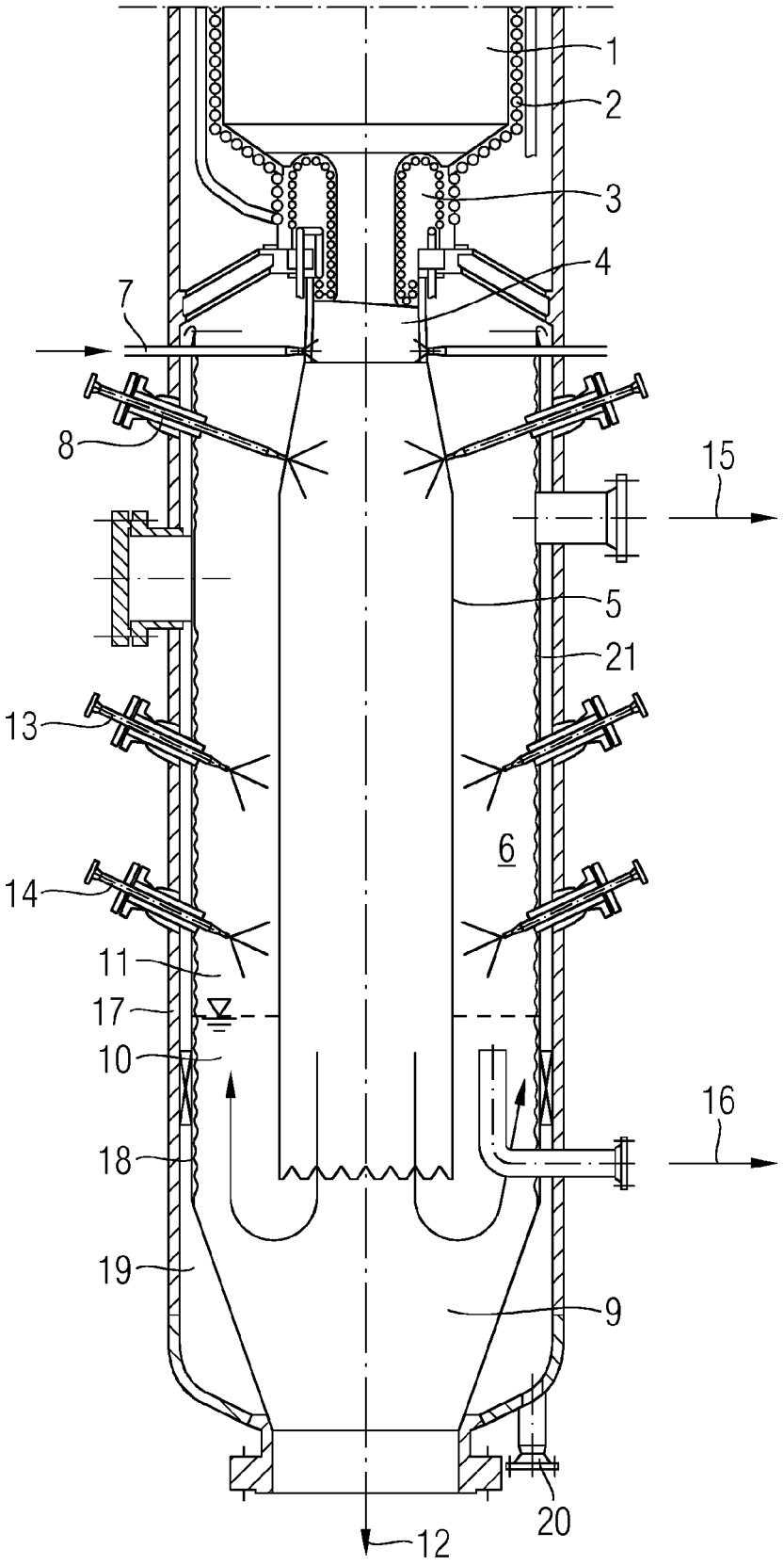
FIG. 1 a quench system with a central tube and water-charged inner casing.

In a gasification reactor 1 according to FIG. 1 with a reaction space bounded by a cooling screen 2, 68 t/h of coal dust are converted at a gross power output of 500 MW with addition of an oxygenous gasifying agent and of steam by means of autothermal partial oxidation at an operating pressure of 4.1 MPa to crude gas and liquid slag. The volume of moist crude gas produced, 145 000 $m^3$/h under normal conditions, and the 4.7 Mg/h of liquid slag formed from the fuel ash flow together at temperatures of 1700° C. through the gas and slag outlet 3 and the guide tube 4 into the central tube 5 of the quenching and scrubbing apparatus 6. At the lower end of the guide tube 4 is disposed the first primary cooling and scrubbing stage, represented by the water injection 7 at the end of the guide tube 4 and directly at the top of central tube 5 as jet 8. The amount of water injected should be such that the crude gas and/or liquid slag are cooled down to below the softening temperature of the slag of 800 to 1000° C. This temperature range enables, simultaneously with the catalytic action of the ash, a sufficiently high reaction rate of the conversion reaction, such that the water content in the crude gas rises by 6.4% by volume under these conditions. The central tube 5 conducts the partly cooled crude gas and the already solidified slag into the water bath 9, and the crude gas rises upward in the form of a bubble column 10 and collects in the annular gap 11. Slag and coarse dust collect in the lower portion of the water bath 9 and are discharged from the system via the slag outlet 12. The bubble column 10 constitutes the second cooling and scrubbing system. The crude gas which rises upward in the annular gap 11 is finally cooled by means of one or more nozzle rings 13 and 14 arranged one on top of another to the saturation temperatures of 200-220° C. which correspond to the pressure, and is also freed at this early stage of a portion of the finer dust and slag components in this third cooling and scrubbing stage. The cooled and scrubbed crude gas is transferred via the crude gas exit 15 from the quenching and scrubbing apparatus 6 into further systems for clean gas production. The excess quenching water is removed in a controlled manner from the water bath 9 via 16, in order to be able to maintain the required water level. The excess water is cleaned and fed back to the quenching and scrubbing apparatus 6 in the circuit. For protection of the pressure casing 17 against erosion and corrosion, an inner casing 18 is fitted, and the annular gap 19 that results is fed via the feed 20 with solids-free condensates or feed water. This water trickles downward as a water film 21 on the inside of the inner casing 18 and is collected in the water bath 9.

Figure 2:
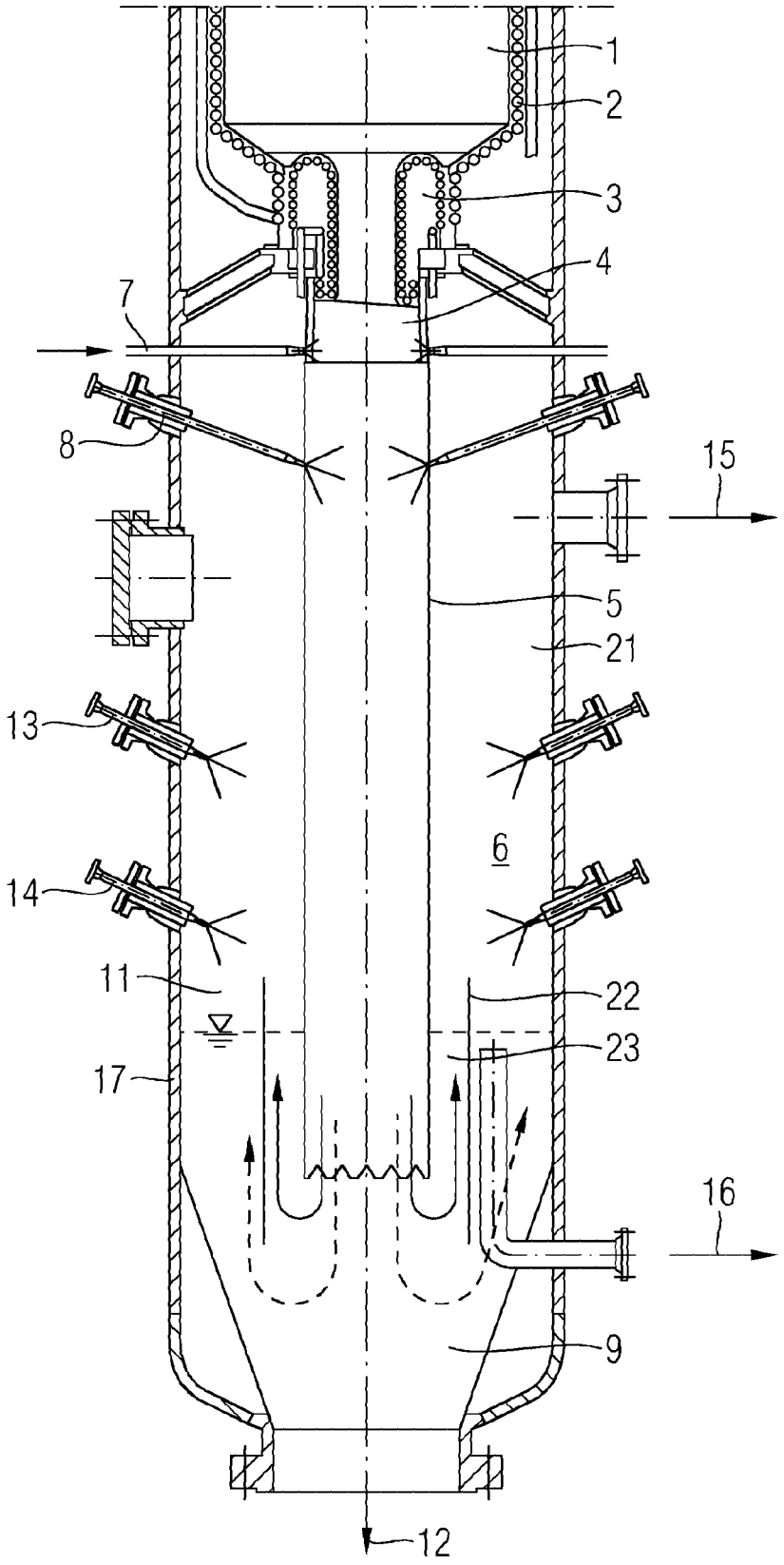
FIG. 2 a quench system with central tube and guide device.

Under the same starting conditions as in the example according to FIG. 1, FIG. 2 shows a modified secondary cooling and scrubbing stage. Crude gas and liquid slag are first subjected to intensive spraying as described in the primary cooling and scrubbing stage at the lower end of the guide tube 4, and passed to the lower end of the central tube 5. Between the central tube 5 and the pressure casing 17 is arranged a lower guide tube 22, such that the emerging crude gas flows upward in the intermediate space formed as a bubble column and constitutes the secondary cooling and scrubbing stage. The lower guide tube 22 is offset downward with respect to the central tube 5, such that the crude gas is conducted to the bubble column 23. The lower guide tube 22 protects the pressure casing 17 from erosion by the slag particles entrained in the crude gas. The crude gas passes, after flowing through the bubble column 23 under pressure, into the annular gap 11, where another intensive spraying operation with water through one or more nozzle rings is effected as a tertiary quenching and cleaning stage. The removal of crude gas and slag are maintained as described, as is the control of the fill level of the water bath 9.

Figure 3:
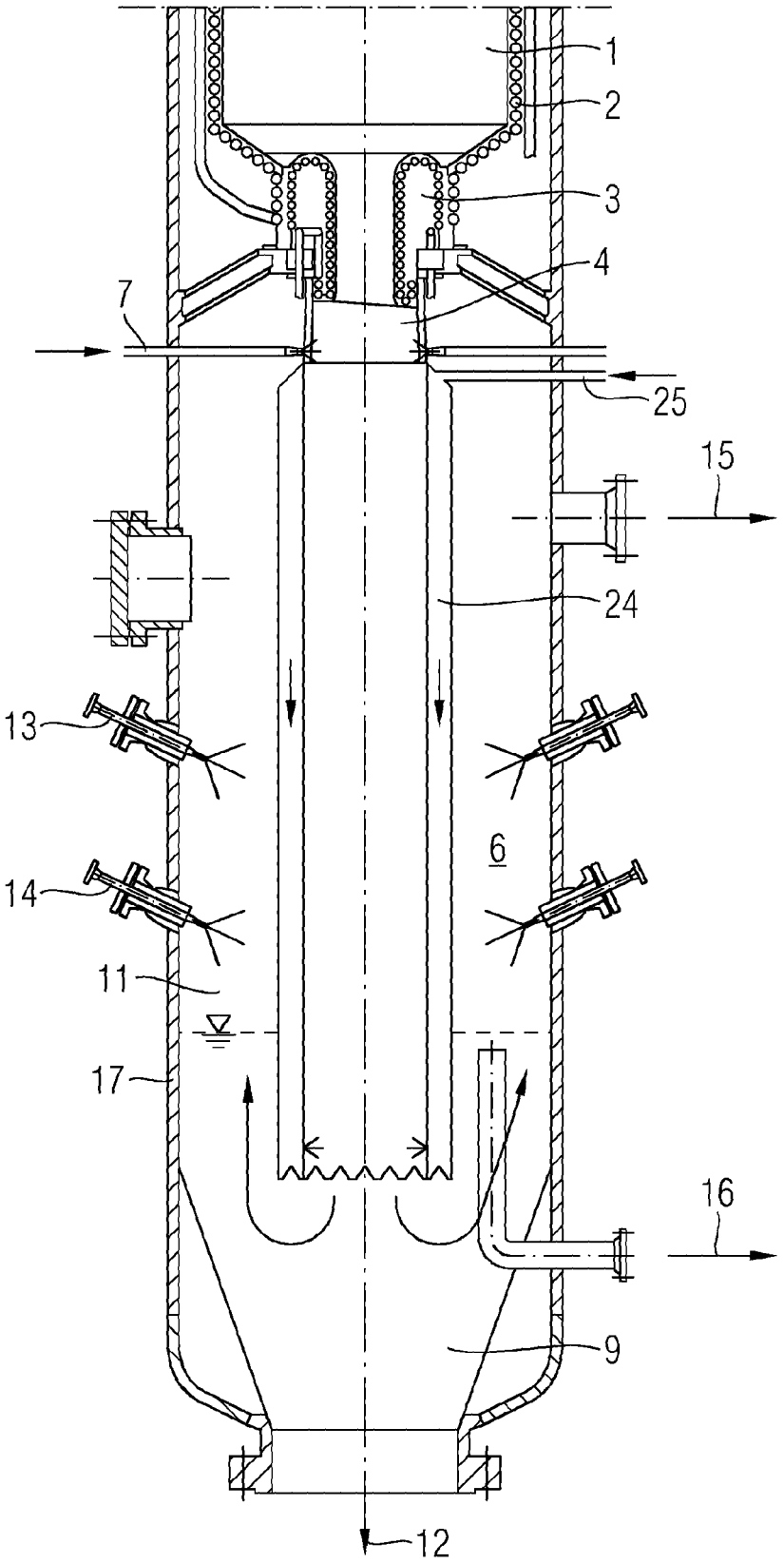
FIG. 3 a quench system with water-filled central tube as jacket.

Under the same starting conditions as in the example according to FIG. 1, FIG. 3 shows a double-walled central tube 24. For protection against excessive heating, the central tube has a double-walled configuration and is cooled with water in the resulting annular gap. The water enters the annular gap of the central tube 24 at the top and exits into the water bath 9 at the lower end. The quenching and scrubbing system according to FIG. 3 may additionally be equipped with an inner casing 18 or an inner guide tube 22 (neither shown here).

The invention also features a process for treatment of crude gases and liquid slag which occur in entrained flow gasification with temperatures of 1200 to 1900° C. and pressures up to 10 MPa, wherein the hot crude gas and liquid slag are transferred from a gasification reactor (1) bounded by a cooling screen (2) via a gas and slag outlet (3) and a water-cooled guide tube (4) into a three-stage quenching and scrubbing apparatus (6), wherein, as a primary scrubbing stage at the lower end of the guide tube (4) and at the start of the central tube (5), intensive water jetting takes place such that the entrained liquid slag is cooled to below the softening point between 800 and 1000° C. and the conversion reaction of carbon monoxide with water vapor to give hydrogen proceeds to close to the equilibrium as a result of the high reaction rate and the catalytic effect of the ash, wherein a central tube (5) which transfers crude gas and slag to a water bath is provided, wherein crude gas and slag are separated and the crude gas rises upward in a bubble column as a secondary quenching and scrubbing stage, wherein the height of the water bath (9) is set to a preset level by means of a control system for removal of the excess water, wherein crude gas and scrubbing water are separated at the upper end of the bubble column, wherein the crude gas is subjected to fine slag deposition and cooling in the annular space (11) by irrigation by means of one or more nozzle rings as a tertiary quenching and scrubbing stage, until the water vapor dew point temperature which is determined by the process pressure is attained, and wherein the cooled and scrubbed crude gas is drawn off at the upper end (15) of the quenching and scrubbing system (6) and sent to further treatment stages for production of a clean gas.

The invention claimed is:

1. A crude gas scrubbing system configured and operable for having a high separation level of dust in an entrained flow gasification unit for the reaction of ash-containing fuels with a gasifying agent containing free oxygen to give a crude gas having a high hydrogen content, comprising:

a gasification reactor operable at temperatures of 1200 to 1900° C. and process pressures up to 10 MPa for processing the fuel through the reactor and for converting the fuel to crude gas and liquid slag, a quencher arranged beneath the gasification reactor, a gas and slag outlet from the reactor into the quencher for transferring the crude gas and liquid slag into the quencher, a central tube in the quencher and connected to the gas and slag outlet and the central tube also dips into a water bath at a lower end of the quencher, the central tube has an upper end and a water jet at the upper end is configured to introduce water into the stream of crude gas and slag;

a lower end of the central tube is configured to separate the slag into the water bath while the crude gas rises upward within a bubble column outside the central tube, a crude gas outlet via which the crude gas leaves the quencher in an upper region of the quencher, at least one nozzle ring between a surface of the water bath and the crude gas outlet and the nozzle ring is configured to spray water into the crude gas, a guide tube concentrically surrounding the lower end of the central tube, wherein the central tube has a double-walled configuration to form an annular channel and cooling water is supplied to a top of the annular channel and leaves an annular gap in the water bath.

2. The crude gas scrubbing system as claimed in claim 1, wherein the lower end of the guide tube is arranged lower than the lower end of the central tube leaving a gap between the guide tube and the slag discharge at the bottom of the water bath.

3. The crude gas scrubbing system as claimed in claim 1, wherein an upper end of the guide tube projects above the surface of a water bath.

4. The crude gas scrubbing system as claimed in claim 1, wherein the control tube and the guide tube are located and configured so that the bubble column forms within an annular space between the central tube and the guide tube.

5. The crude gas scrubbing system as claimed in claim 1, further comprising a guide tube connecting the central tube to the gas and slag outlet, and a jet for delivering water into the center of the guide tube.

6. The crude gas scrubbing system as claimed in claim 1, further comprising a guide tube connecting the central tube to the gas and slag outlet, and an injector for recycling cooling water for the guide tube into the hot stream of crude gas and slag at the lower end of the guide tube.

7. The crude gas scrubbing system as claimed in claim 1, further comprising a pressure casing of the quencher and an inner casing of the quencher located to form an annular gap formed between the casings, such that water fed in at a base rises within the annular gap, overtops an upper edge of the inner casing and runs down an inside of the inner casing as a water film.

8. The crude gas scrubbing system as claimed in claim 1, wherein the central tube is configured such that a velocity of the crude gas in the central tube is less than 20 m/s.

9. The crude gas scrubbing system as claimed in claim 4, wherein the annular space is a cavity configured so that the crude gas in the annular space has a mean flow rate of less than 0.5 m/s.

10. The crude gas scrubbing system as claimed in claim 1, wherein the quencher is configured so that the crude gas is cooled in the quencher down to a water vapor saturation temperature which is determined by a process pressure.

* * * * *